US006105313A

United States Patent [19]

Holloway et al.

[11] Patent Number: 6,105,313

[45] **Date of Patent: *Aug. 22, 2000**

[54] HANDICAP DOOR WITH EDGE SEALS

[76] Inventors: Max M. Holloway, 4568 W. McCarty La., Rochester, Ind. 46975; Chad M. Holloway, 4921 Southlane Rd., Fort Wayne, Ind. 46815

[ * ] Notice: This patent issued on a continued prosecution application filed under 37 CFR 1.53(d), and is subject to the twenty year patent term provisions of 35 U.S.C. 154(a)(2).

[21] Appl. No.: 09/228,327

[22] Filed: Jan. 11, 1999

[51] Int. Cl.[7] ..... E06B 7/28

[52] U.S. Cl. ..... 49/319; 49/318

[58] Field of Search ..... 49/316, 317, 318, 49/319, 320, 321, 326

[56] References Cited

U.S. PATENT DOCUMENTS

| | | | |
|---|---|---|---|
| 458,465 | 8/1891 | Kennedy . | |
| 595,128 | 12/1897 | McArthur . | |
| 608,893 | 8/1898 | McArthur . | |
| 1,345,967 | 7/1920 | Smelser . | |
| 1,389,423 | 8/1921 | Davis . | |
| 1,795,324 | 3/1931 | Wilhelm . | |
| 2,268,114 | 12/1941 | Foster et al. | 49/318 |
| 2,283,577 | 5/1942 | Roby | 49/326 X |
| 2,714,232 | 8/1955 | Straussler . | |
| 3,059,287 | 10/1962 | Baruch et al. | 49/319 X |
| 4,656,779 | 4/1987 | Fedeli . | |

FOREIGN PATENT DOCUMENTS

| | | | |
|---|---|---|---|
| 877594 | 12/1942 | France | 49/319 |

*Primary Examiner*—Jerry Redman
*Attorney, Agent, or Firm*—Randall J. Knuth

[57] ABSTRACT

A bi-directionally swinging door which seals into a doorjamb. A push button actuator causes the retractable edges to move away from the doorjamb and retract into the door, allowing the door swing either in or out.

5 Claims, 12 Drawing Sheets

HANDICAP DOOR WITH EDGE SEALS

BACKGROUND OF THE INVENTION

1. Field of the Invention

The present invention relates to a door and, in particular, to a bi-directionally swinging door in which at least one of the edges of the door seals positively into a doorjamb.

2. Description of the Related Art

Traditional doors operate by means of a doorknob with bolt. When the door is in the closed position, the bolt of the doorknob fits into a recess drilled into the doorjamb and secures the door from being opened. To open the door, the doorknob is turned which retracts the bolt away from the doorjamb and into the interior of the door. Once the bolt clears the doorjamb, the door is able to swung open. Typically, the door will be hung on single-direction hinges which limits the door's swinging movement to a single direction, either in or out of the doorway.

Current door designs may not be applicable for use by someone who is disabled or handicapped. For example, turning the doorknob may be difficult for a person who lacks dexterity or has limited motor function. Likewise, someone who is confined to a wheelchair, walks with the aide of crutches or a cane, or has arthritis may have difficulty operating a door with a rotatable or twistable doorknob.

An additional problem with the traditional single-directionally hinged door is that the door must be opened toward the door's operator half of the time, either when ingressing or egressing through the doorway. Consequently, half of the time, one has to step-out or get-out of the way of the opening door. While seemingly a simple task for one able, this is more challenging for someone confined to a wheelchair, or walks with the assistance of crutches or a cane.

Another disadvantage with current door designs is that the door is held shut merely by the doorknob's bolt. The traditional doorknob's bolt does not provide much security against forcible entry. A potential intruder may gain entry simply by cutting the bolt or breaking the doorjamb around the location where the bolt is inserted.

SUMMARY OF THE INVENTION

According to the present invention, a door contains a plurality of retractable edges and is hinged to swing bi-directionally. The retractable edges seal into the doorjamb whereby securing the door to the doorjamb when the door is closed.

The invention, in one form thereof, is a door system for use with a doorjamb. The door system includes a door with at least one retractable edge. The door is connected to the doorjamb by a bi-directional hinge. The retractable edge extends into the doorjamb. Retraction means retracts the retractable edge from the doorjamb to enable the door to swing on the hinge. In alternate embodiments, two or three edges of the door are extendable into or about the doorjamb.

The invention, in another form thereof, is a method of operating a door. The method includes the steps of supplying a door in which at least one edge is extendable into a doorjamb; pushing a push button activator; retracting into the door, the edge which extends into the doorjamb; swinging the door one of inward or outward, relative to the doorjamb; returning the door to a closed position; and extending the retracted edge back into the doorjamb.

The invention, in yet another form thereof, is a door system for use with a doorjamb. The door system includes a door with an upper retractable edge, a lower retractable edge, and a side retractable edge. The door contains a front face and a back face and is bi-directionally hinged to the doorjamb. The upper retractable edge, lower retractable edge and side retractable edges are extendable into the doorjamb. A push button activator activates retraction of the retractable edges. There is an upward extending rod and a downward extending rod. Both upward extending rod and downward extending rod have a first and second end. The first upward extending rod end attaches to the upper edge and the second upward extending rod end is retractably attached to the push button actuator. The first downward extending rod end is attached to the lower edge and the second downward extend rod end is retractably attached to the push button actuator. A plurality of trapezoidal members with an angled surface are located along the upward extending rod and downward extending rod. A plurality of transverse rods have two ends. One transverse rod end is attached to the retractable edge. A roller is affixed to the second transverse rod end and rides along the angled surface of the trapezoidal member whereby movement of said upward extending rod and downward extending rod toward said push button actuator permits said plurality of transverse rods to move toward said upward extending rod and downward extending rod. A cylinder return bar is operatively connected to the upper retractable edge, lower retractable edge, and said side retractable edge. The cylinder return bar has an open and close position. When in the open position, the upper retractable edge, lower retractable edge, and said side retractable edge are prevented from extending into the doorjamb. When in the closed position, the upper retractable edge, lower retractable edge, and side retractable edge are permitted to extend toward the doorjamb. There is a lever with a cable which extends from the door. The cable attaches to the doorjamb. The lever is operatively connected to the cylinder return bar such that when the door is opened, the cable is pulled in a direction out of the door, causing the cylinder return bar to move from the close position to said open position.

An advantage of the present invention is the ease by which one can operate the door. In one embodiment, the push button actuator is located on both the front and back face of the door. An operator opens the door by merely pressing the push button actuator while pushing the door away from oneself. The push button actuator is easier to operate than a traditional rotatable or twistable doorknob by a disabled person. For example, a person with arthritis or limited motor dexterity will be able to operate the present invention more easily then a traditional doorknob.

A second advantage of the present invention is that the bi-directionally swinging door allows an operator to push the door open when both ingressing and egressing through the doorway. Consequently, an operator never has to pull the door towards oneself when operating the door. Since it may be difficult for one disabled to step-out or get-out of the way of the opening door, the present invention is easier to operate by someone who is disabled, than a traditional single directionally swinging doors.

An additional advantage of the present invention is the increased strength and security realized by the door sealing into the doorjamb. Rather than merely having a door knob's bolt inserted into a doorjamb, an entire edge of a door seals into the doorjamb. Consequently, the door is held more securely closed than a traditional door and doorjamb arrangement. Moreover, it is harder for a potential intruder to gain entry into a home or building which uses the door system of the present invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1A:
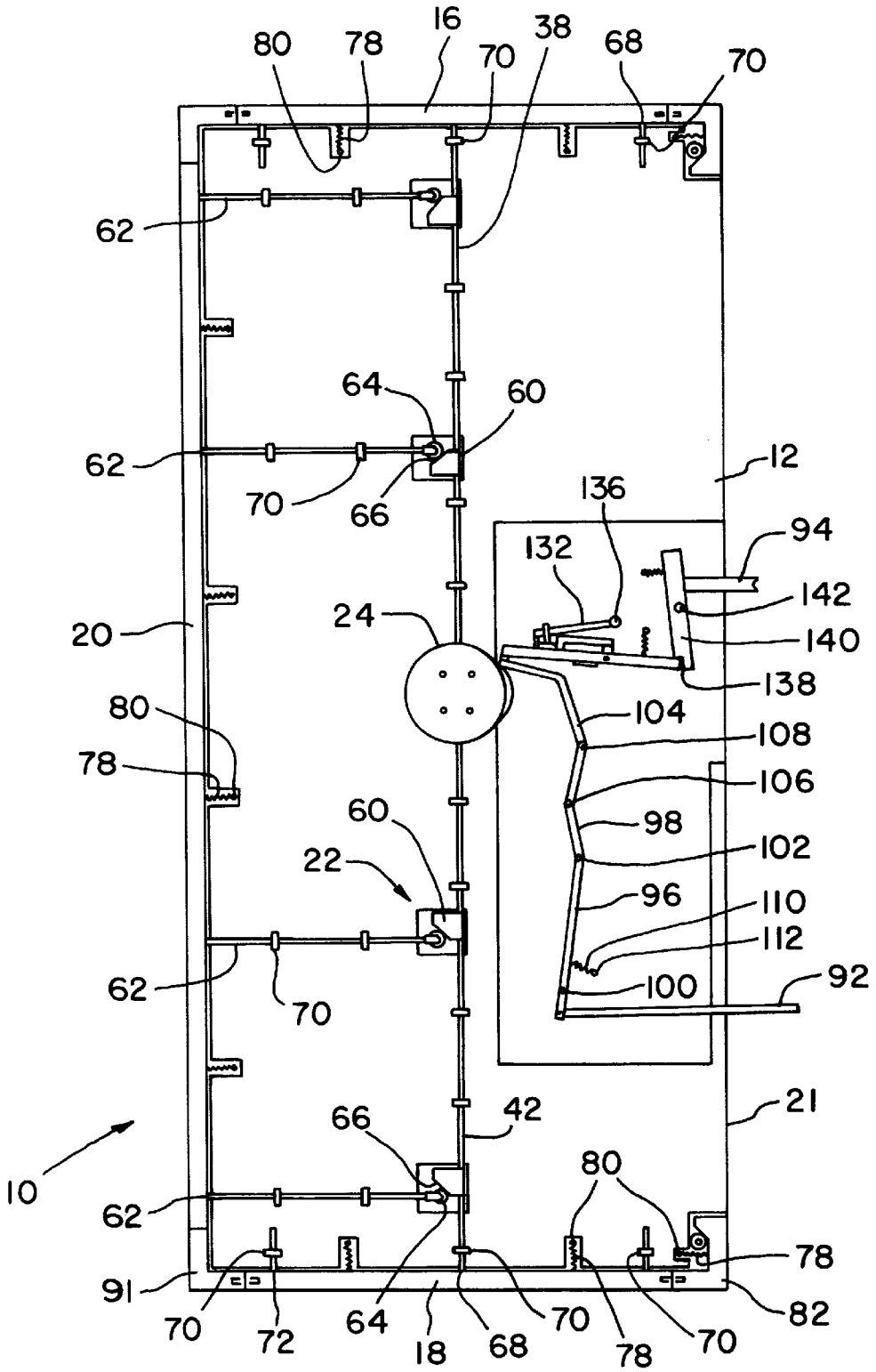
FIG. 1*a* is a perspective view of the door system of Embodiment I of the present invention in an open door configuration.
Figure 1B:
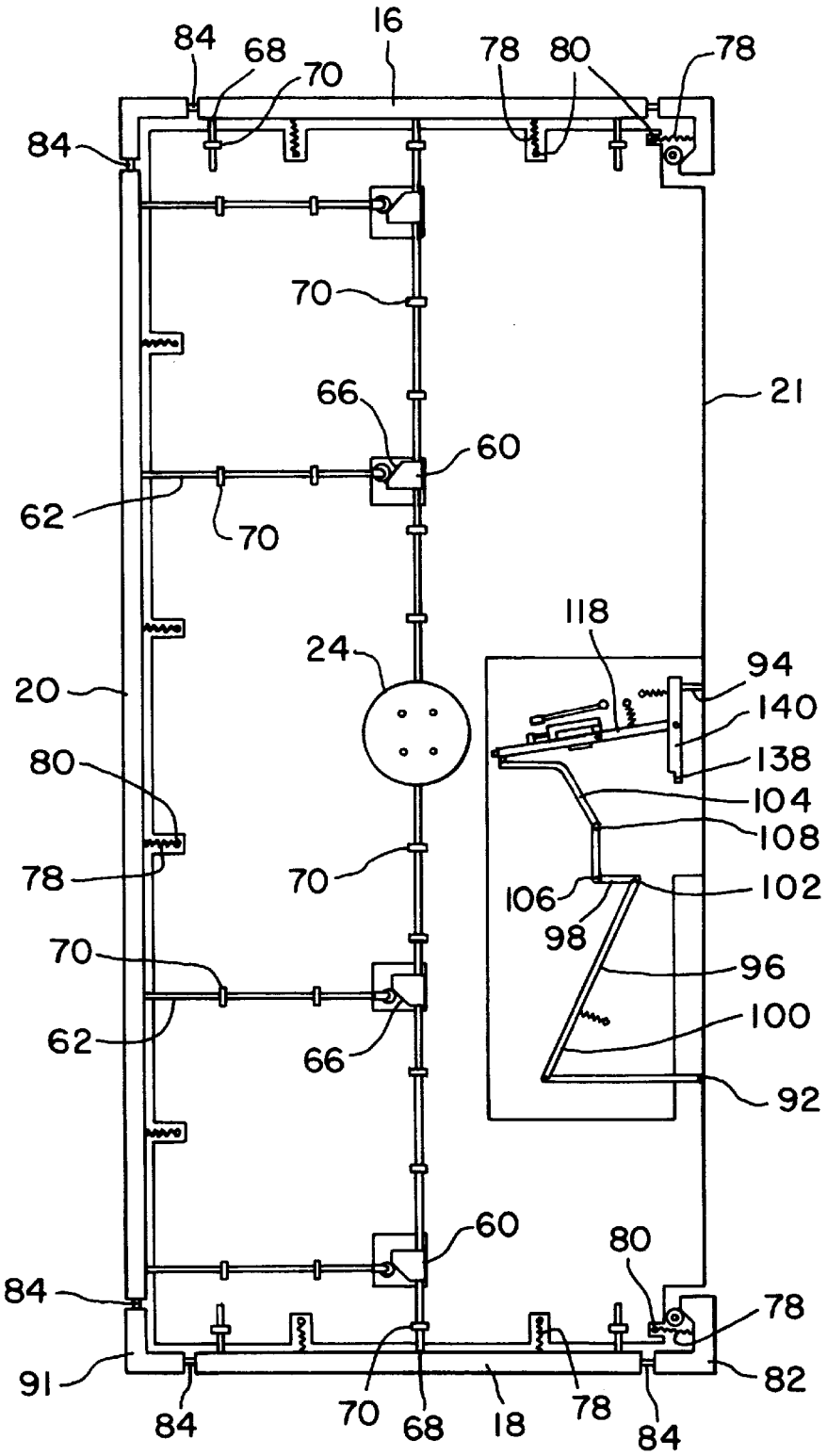
FIG. 1*b* is a perspective view of the door system of Embodiment I of the present invention in a closed door configuration
Figure 4:
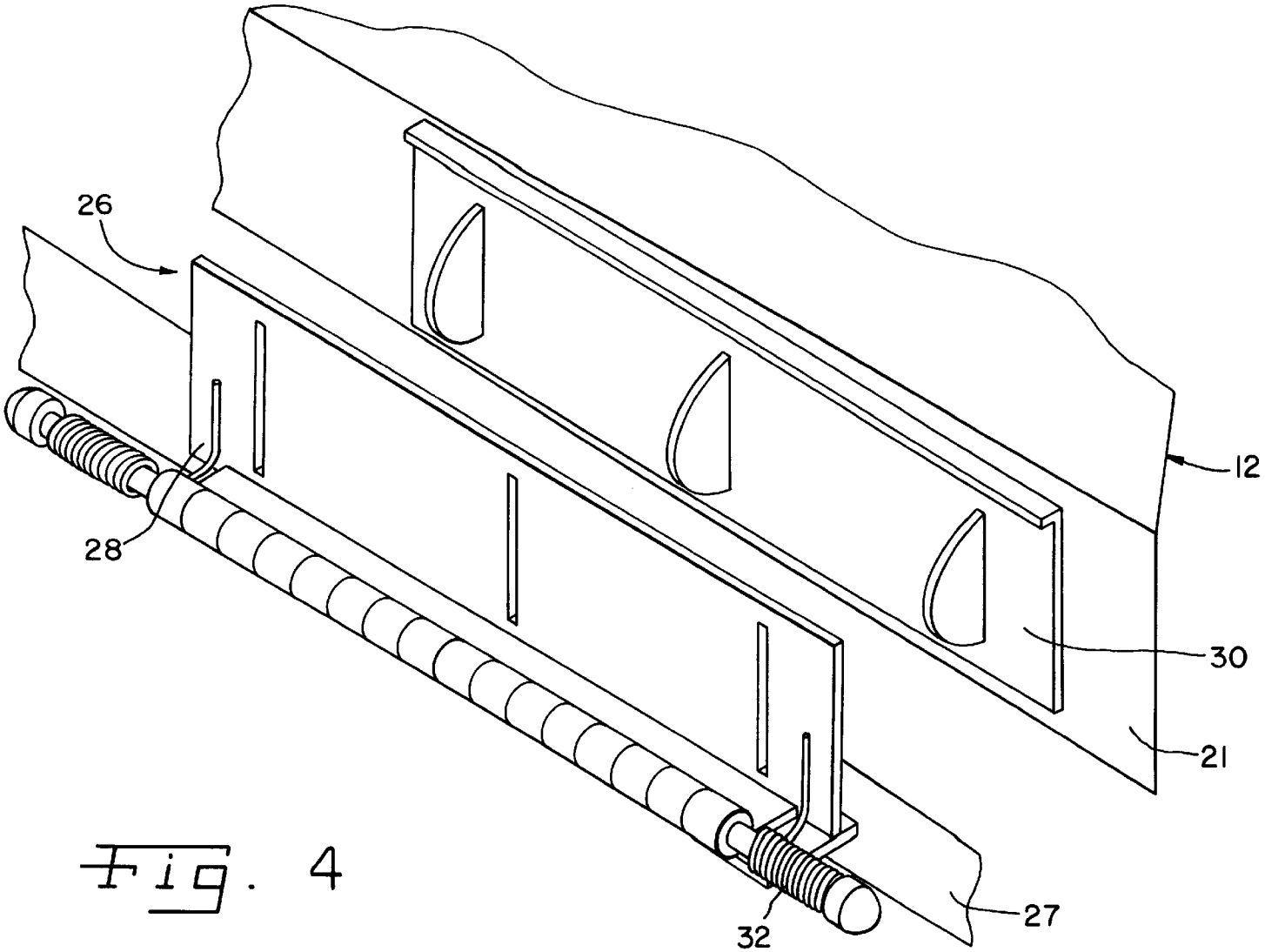
FIG. 4 is a perspective view of a bi-directional hinge used to mount the door system invention to a doorjamb.

Referring now to the drawings, and in particular to FIGS. 1*a* & 1*b*, there is shown a perspective view of door system 10 which comprises the present invention. FIG. 1*a* depicts door system 10 in a open door confirmation. FIG. 1*b* depicts door system 10 in a closed position or confirmation. Door 12 contains upper retractable edge 16, lower retractable edge 18 and side retractable edge 20 and non-retractable edge 21. Retracting means 22 includes push button actuator 24. To operate door system 10, an operator pushes push button actuator 24. As a result, upper, lower, and side retractable edges 16, 18, and 20, retract inward, away from a door jamb (not shown) and into door 12. Once the retractable edges have retracted, door 12 may pivot in or out along bi-directional hinges (FIG. 4). When door 12 is swung closed, upper, lower, and side retractable edges 16, 18, and 20, return to their closed door position by extending back into the door jamb.

Referring to FIG. 4, hinge 26 pivotally attaches door 12 to door jamb 27. Bi-directional hinge 26 comprises door jamb segment 28 which mates with door segment 30. Jamb hinge segment 28 is mounted to door jamb 27 and door hinge segment 30 is mounted to non-retractable edge 21 of door 12. Hinge spring 32 biases jamb hinge segment 28 with door hinge segment 30. During the operation of door system 10, door 12 swings either inward or outward on hinges 26.

Figure 8:
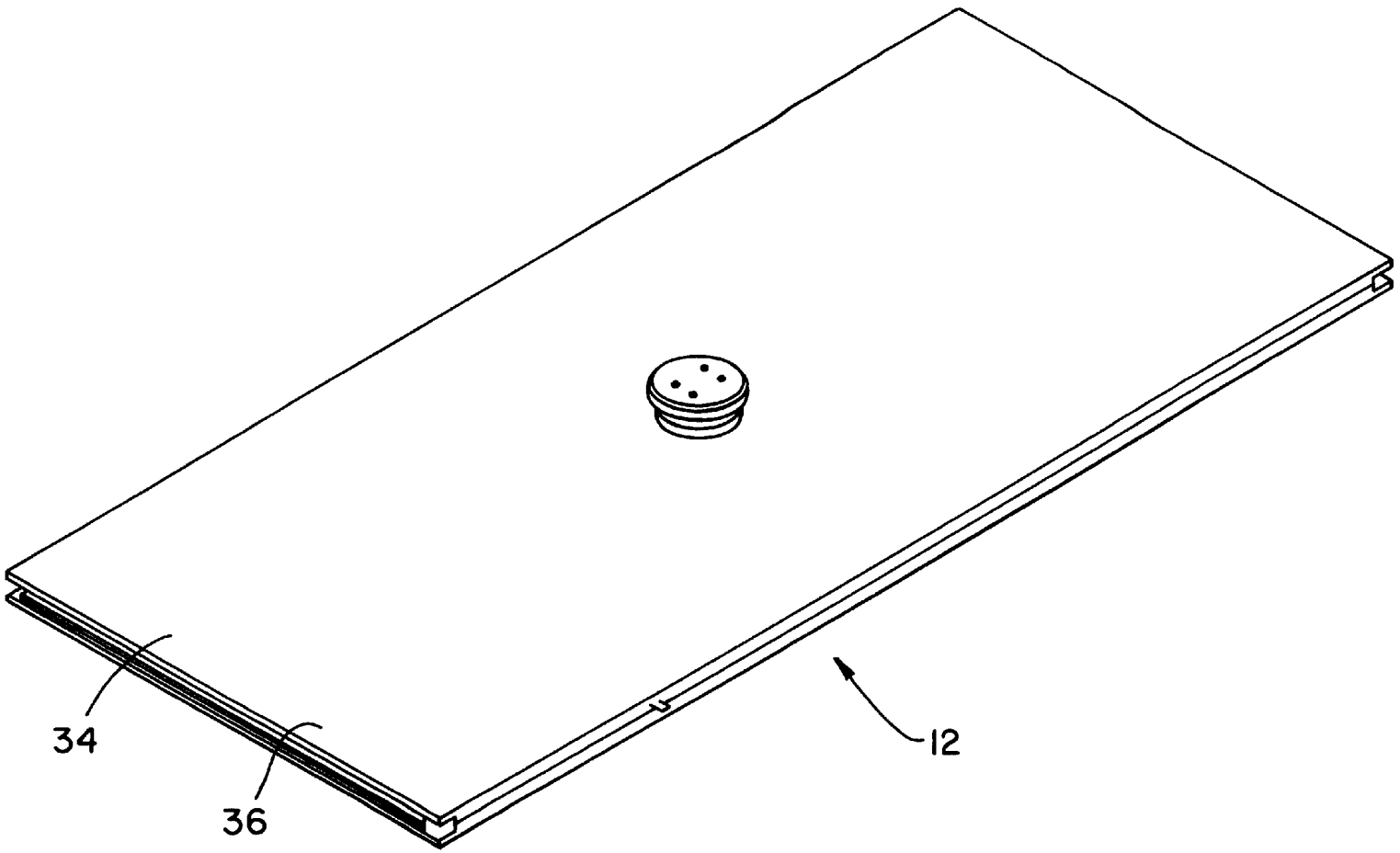
FIG. 8 is a perspective view of the door system of the present invention depicted in FIG. 1.

Referring to FIG. 8, cover 34 fits onto door 12 and forms front face 36, a similar cover to cover 34, attaches to the opposite side of door 12 to form a backface (not shown).

Figure 5:
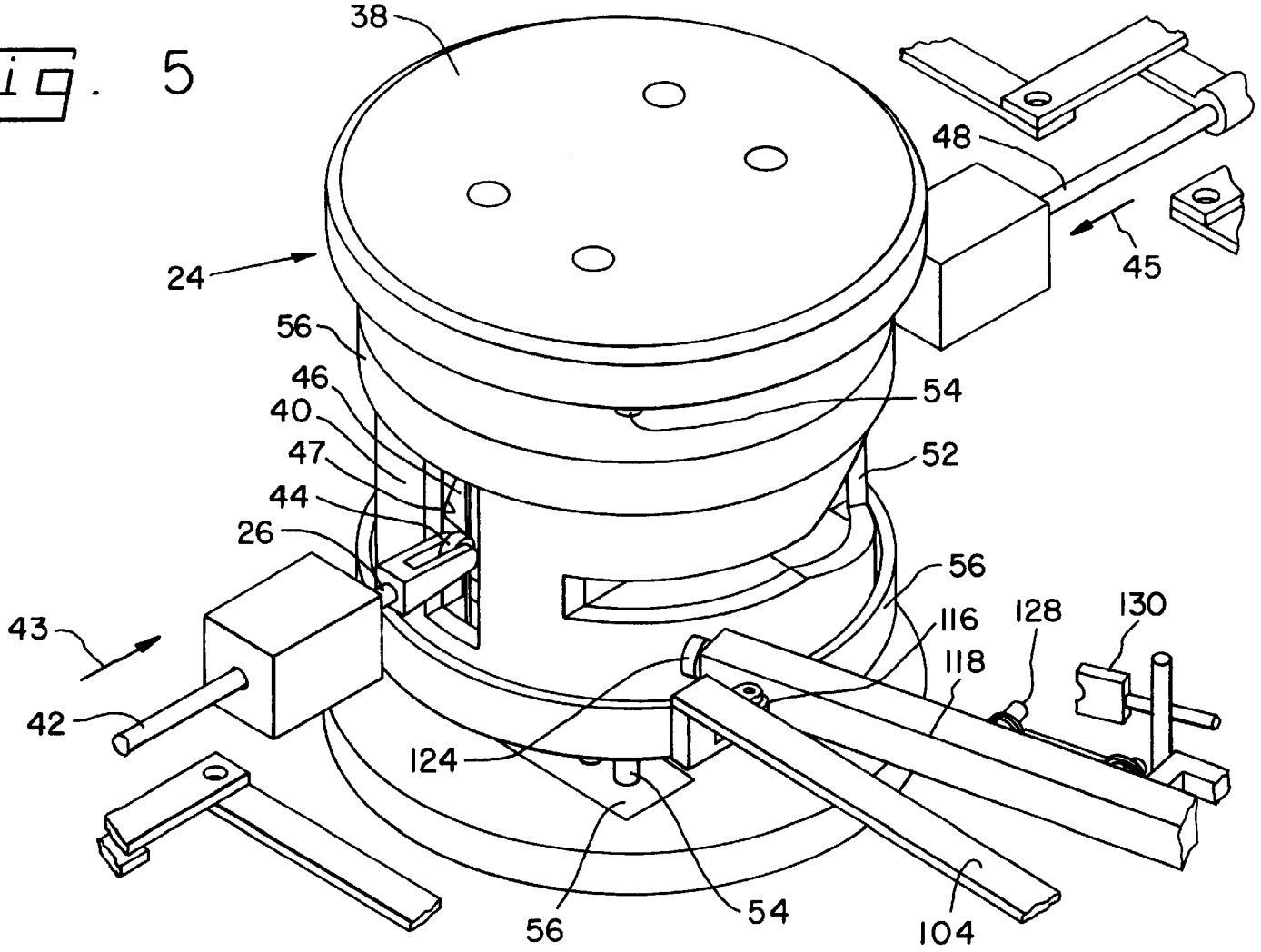
FIG. 5 is an enlargement of a push button actuator of Embodiment I.
Figure 6:
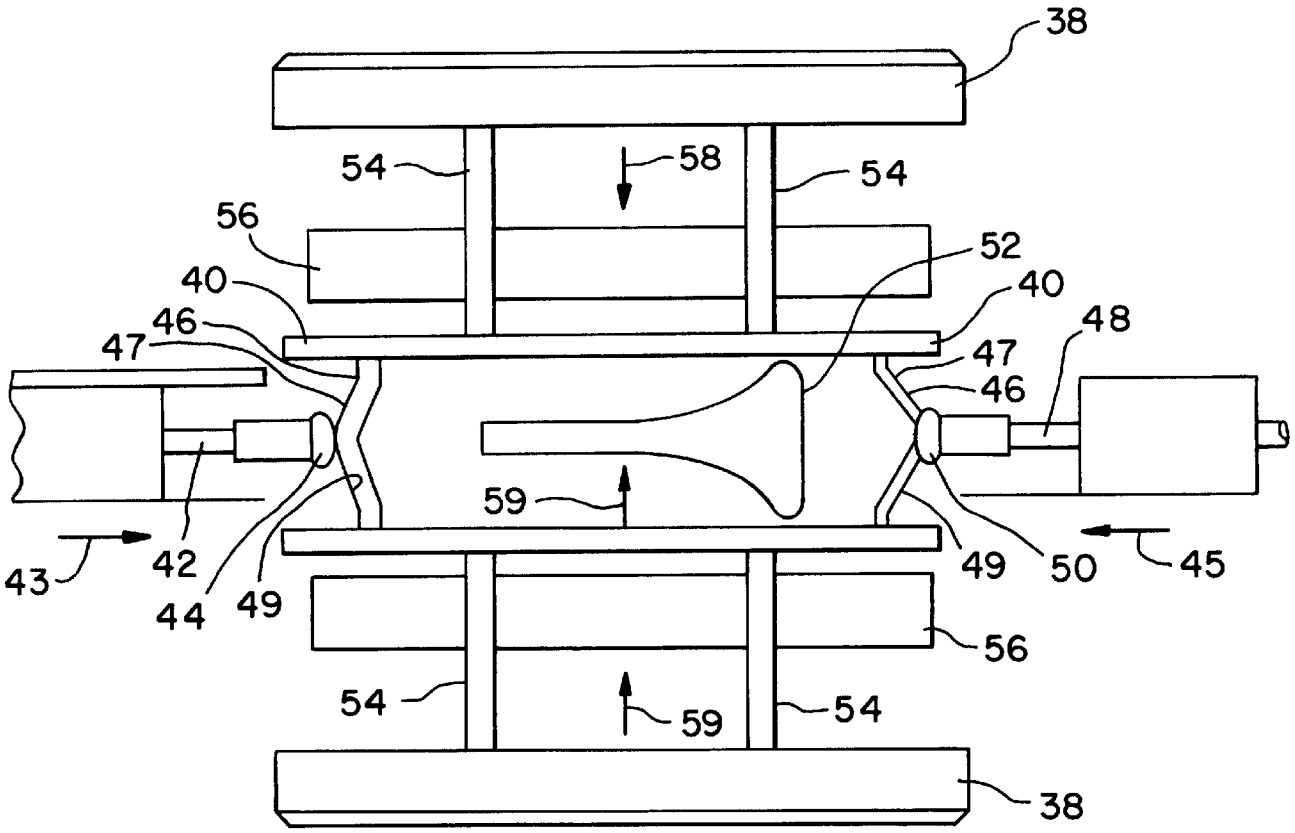
FIG. 6 is a cross-sectional view of the push button actuator of FIG. 5.

Referring to FIGS. 5 and 6, push button actuator 24 activates the retraction of upper, lower, and side retractable edges 16, 18, and 20. Push button actuator 24 includes pad 38 and actuator cylinder 40. Actuator cylinder 40 contains two v-notches 46 cut into actuator cylinder 40. A slit 52 is cut through cylinder 40. A pair of cams 54 pass through brace 56 and attach actuator cylinder 40 to push button pad 38. Brace 56 is rigidly attached to actuator cylinder 40. As push button pad 38 is depressed, brace 56 gives rigidity to push button actuator 24.

Downward extending rod 42 contains downward extending rod roller 44 which is in contact with one v-notch 46. Upward extending rod 48 contains upward extending rod roller 50, which is in contact with the other v-notch 46. Downward and upward extending rods 42, 48 are biased against v-notch 46 by springs (not shown). When push button pad 38 is depressed in the direction of arrow 58, actuator cylinder 40 is displaced in direction 58. As actuator cylinder 40 moves in direction 58, downward extending rod roller 44 rolls along actuator v-notch upper surface 47. As a result, downward extending rod 42 retracts inward toward push button actuator 24 in direction 43. In addition, depressing pad 38 allows upward extending rod roller 50 to roll down along actuator v-notch, upper surface 47, which in turn, permits upward extending rod 48 to retract inward towards push button actuator 24 in direction 45.

When push button pad 38 is pushed in direction 59, actuator cylinder 40 moves in direction 59. As a result, downward extending rod roller 44 rolls along actuator v-notch lower surface 49, which causes downward extending rod 42 to retract in direction 43. In addition, depressing pad 38 in direction 59 allows upward extending rod roller 50 to roll down actuator v-notch lower surface 49, thereby permitting upward extending rod 48 to retract in direction 45.

Referring back to FIGS. 1*a* and 1*b*, actuation of push button pad 38 allows downward extending rod 42 to move inward towards push button actuator 24 which, in turn, permits lower retractable edge 18 to retract inward or into door 12 and away from the door jamb. As upward extending rod and lower extending rod 24, 26 retract into door 12, side retractable edge 20 also retracts into door 12.

Retraction means comprises upward and downward extending rods 42, 48 and transverse rods 62. The retraction means provides for the retraction of upper, lower, and side retractable edges 16, 18, and 20, respectively to retract away from the door jamb and into door 12.

A plurality of trapezoidal members 60 are located along upward and downward extending rods 42, 48. Transverse rods 62 are connected on one end to side retractable edge 20. A transverse roller 64 is located on the opposite end of each transverse rod 62. Transverse roller 64 rides along angle surface 66 of trapezoidal member 60.

When downward extending rod 42 retracts towards push button actuator 24, transverse rod roller 64 rolls along angle surface 66. Transverse rod 62 retracts towards downward extending rod 42. Upward extending rod 48 retracts towards push button actuator 24 allowing upper transverse rod 62 to retract into door 12. Side retractable edge 18 retracts into door 12 as transverse rod 62 retracts into door 12. In addition, upper retractable edge 16 and lower retractable edge 18 retract into door 12 as upper extending rod 38 and lower extending rod 42 retract into door 12.

Figure 3:
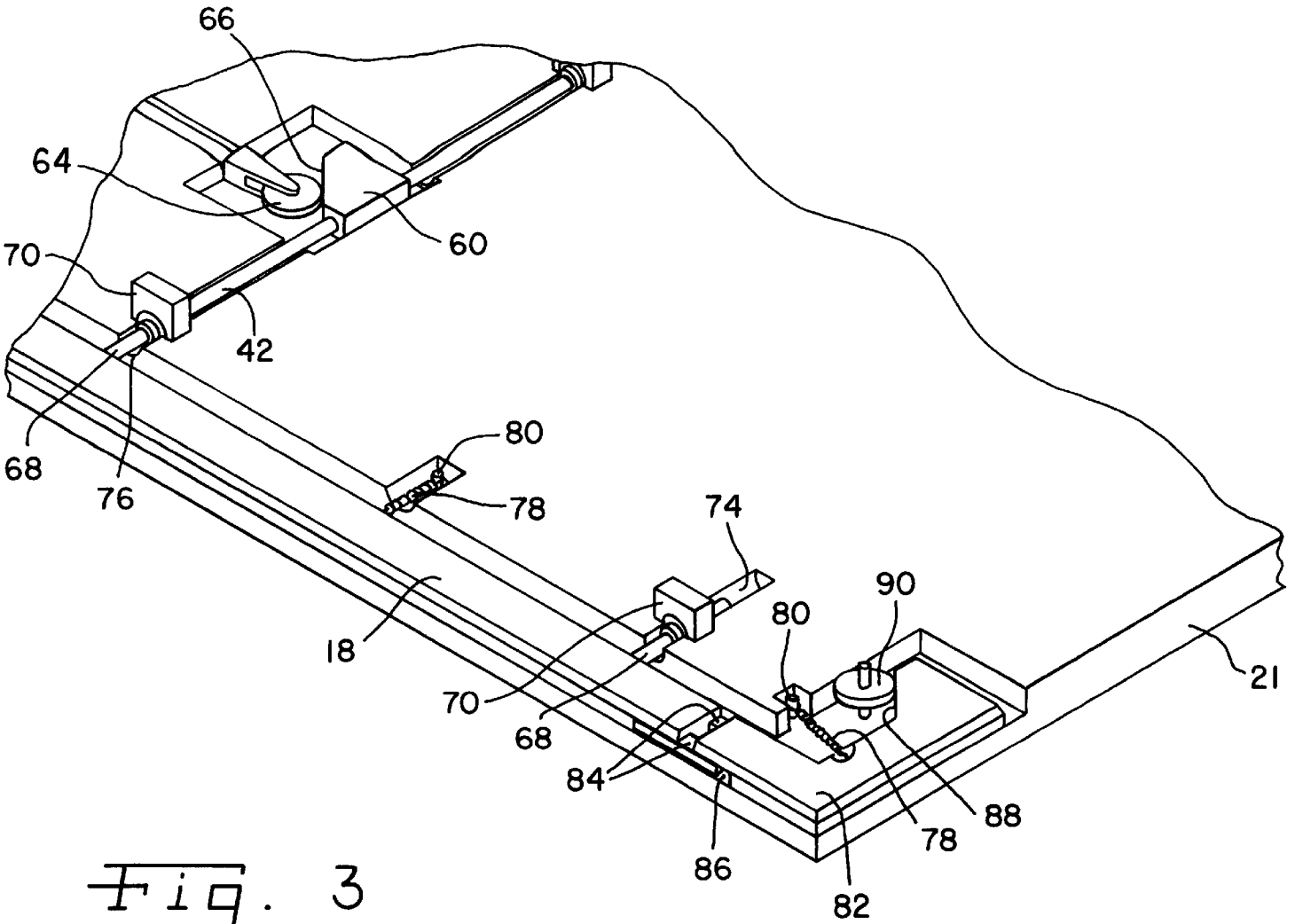
FIG. 3 is an enlargement of FIG. 1 showing an enlargement of the retraction means depicting a retractable edge and corner member of the door system in an open door configuration of Embodiment I.

Referring to FIG. 3, guide pins 68 help guide the retractable edges, such as lower retractable edge 18 as they retract into door 12. Guide blocks 70 are disposed semiannularly around guide pins 68 and downward extending rod 42. Guide blocks 70 ensure that guide pin 68 slides within guide channel 74. Additional guide blocks 70 ensure that downward extending rods 42 retract and extend smoothly within downward extending rod channel 76. As a result, lower retractable edge 18 is guided for smooth retraction and extension relative to door 12. Guide blocks 70 are also disposed semiannularly around upward extending rod 48 and transverse rods 62 (See FIGS. 1*a* and 1*b*).

A plurality of retractable edge springs 78 are attached between lower retractable edge 18 and a plurality of screws 80. Screws 80 are driven into door 12. When door 12 is in the closed position (FIG. 1*b*), springs 78 are stretched. As door 12 opens, springs 78 assist in applying force to retract retractable edge 18 into door 12. Similarly, springs 78 assist in applying force to retract retractable edges 18 and 20 into door 12 when door 12 is opened (FIG. 1*a*).

While the preferred embodiment is to use guide pins 68, along with guide blocks 70 to ensure smooth retraction and extension of lower retractable edge 18, other means may be used to provide suitable guiding.

Lower corner member 82 extends outward from door 12 when door 12 is in the closed door position and is retracted into door 12 when door 12 is in the open door position. Lower corner member 82 is slidably connected to lower retractable edge 18 by bars 84 which are disposed inside grooves 86. When door 12 is opened or closed, lower corner member 82 slides on bar 84 towards or away from lower retractable edge 18, respectively.

Lower corner member 82 contains an angled surface 88. Roller 90 is in contact with angled surface 88. Spring 78 is stretched between lower corner member 82 and screw 80 when door 12 is in a closed door position. Spring 80 biases lower corner member 82 toward lower retractable edge 18 when door 12 is in the closed door position. When downward extending rod 42 retracts towards push button actuator 24, lower inside corner member moves upward or in the direction of push button actuator 24. As lower corner member moves upwards towards push button actuator 24, roller 90 rides along angled surface 88. Spring 78 applies force to retract lower corner member 82 towards lower retractable edge 18.

Figure 2:
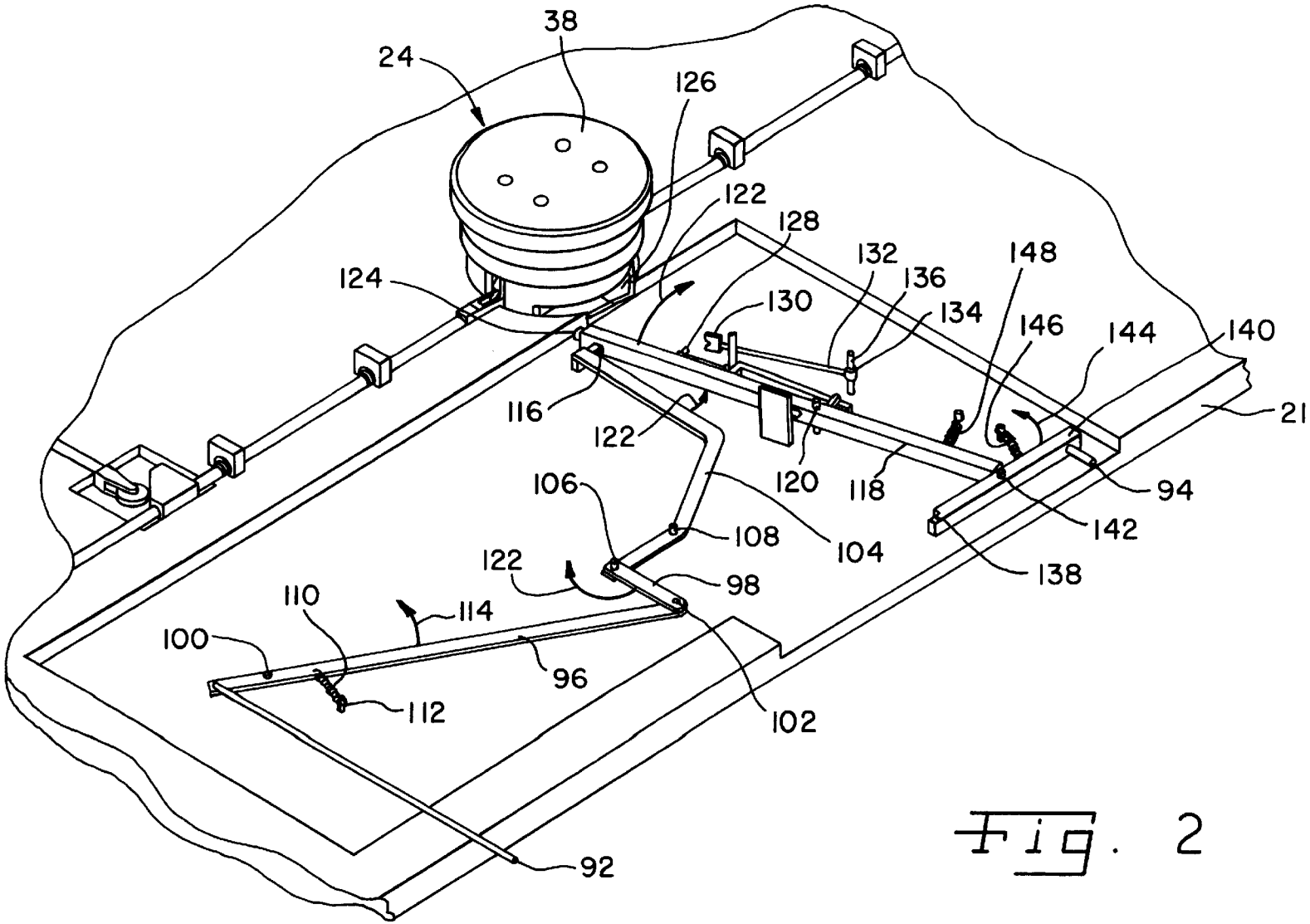
FIG. 2 is an enlargement of FIG. 1 showing a retraction means Embodiment I of one form of the present invention.

Referring to FIG. 2, a series of pivotable levers and bars are used to secure retractable edges 16, 18, and 20 in an open door position, i.e., retracted into door 12. Cable 92 and pin 94 both extend through the inside on non-retractable edge 21. Cable 92 is permanently attached to the inside of the door jamb (not shown). Cable 92 is also attached to lower lever 96. Lower lever 96 is pivotally attached to door 12 by bolt 100. Bolt 100 is secured to door 12. Middle lever 98 is pivotally attached on one end to lower lever 96 by bolt 102 and pivotally mounted or linked at the other end to upper lever 104 by bolt 106. Upper lever 104 is pivotally mounted to door 12 by bolt 108. Bolt 108 is secured to door 12. Upper lever roller 116 is attached to the end of upper lever 104 and is in contact with return bar 118. Return bar 118 is pivotally mounted to door 12 by bolt 120.

Spring 110 is connected to and stretched between lower lever 96 and a screw 112 which is fixed to door 12. Spring 110 biases lower lever 96 to assist in returning lower lever 96 from its open door configuration (FIG. 1*a*) to its closed door configuration (FIG. 1*b*). As door 12 is opened, cable 92 is drawn out of door 12 and towards the door jamb. As cable 92 is drawn outward of door 12, lower lever 96 pivots in direction 114 about bolt 100. As door 12 is closed, spring 110 assists in returning lower lever 96 to its closed door position. Upon opening door 12, cable 92 is pulled outward of door 12 causing lower lever 96 to pivot in direction 114. Lower lever 96 in turn, causes middle lever 98 to pivot in direction 122. As middle lever 98 rotates in direction 122, upper lever 104 rotates upward in the direction 122 since they are connected.

As upper lever 104 proceeds upward in direction 122, upper lever roller 116 rolls along return bar 118. Consequently, return bar 118 pivots upward in direction 122. As return bar 118 pivots in direction 122, a return bar roller 124, located on the end of return bar 118, swings through push button actuator slit 52 of push button actuator 24.

As return bar 118 continues upward, return bar pin 128 is brought into contact with lever 130. Lever 130 is attached to a horizontal pivot rod 132. Horizontal pivot rod 132 contains horizontal pivot rod aperture 134, which is disposed annularly about vertical pivot rod 136. Horizontal pivot rod 132 is biased by a spring (not shown) for returning horizontal pivot rod 132 back to its original or closed door position as door 12 is closed. In addition, the biasing of horizontal pivot rod 132 assists in returning return bar to its closed door position as door 12 is being closed.

As return bar 118 continues to swing in direction 122, return bar 118 will catch in notch 138 of lever 140. When return bar 118 pivots in direction 122, return bar 118 causes lever 140 to pivot about bolt 142 in direction 144. Lever 140 is biased by spring 146, which assists lever 140 in pivoting about bolt 142 as door 12 is opened.

Return bar 118 is attached to a spring 148 which biases return bar 118 and assists in returning return bar 118 to its closed position as door 12 is closed. Once return bar 118 swings upward through and clears push button actuator 22, upper, lower, and side retractable edges 16, 18, and 20 are locked in a retractable position or open door position. Springs 70 help to keep upper, lower, and side retractable edges 16, 18, and 20 in their close door position.

As door 12 is swung closed, pin 94 contacts the door jamb, whereby pin 94 is pushed inward toward non-retractable edge 21 and engages lever 140 whereby causing lever 140 to pivot in direction 144. Lever 140 pivots enough in direction 144 allowing return bar 118 to be liberated from notch 138. Consequently, the spring from horizontal pivot rod 132 and spring 148 push return bar 118 in a downward direction opposite of direction 122 Return bar roller 124 will pass through push button actuator slit 52. As return bar roller 124 passes through actuator slit 52, push button cylinder 40 (FIG. 6) is re-aligned or returned to its closed door position (i.e., in the center of push button 24). As actuator cylinder 40 is re-aligned or returned to its center position or closed door position, downward and upward extending rod rollers 44, 50, respectively, roll along the surface of v-notch 46, returning rollers 44, 50 to their closed door position. Consequently, downward and upward extending rods 42, 48, respectively, return to their closed door configuration.

As upward extending rod 48 and downward extending rod 42 are pushed upward or downward, respectively, upper, lower, and side retractable edges extend outward, from door 12.

To operate the door, an operator pushes push button actuator pad 38. As a result, upper, lower, and side retractable edges 16, 18, and 20 retract inward, away from the door jamb and into door 12. Once the retractable edges have retracted, door 12 may pivot in or out along the by-directional hinges. When door 12 is swung closed, upper, lower, and side retractable edges return to their closed door position by extending back into the door jamb.

Figure 7:
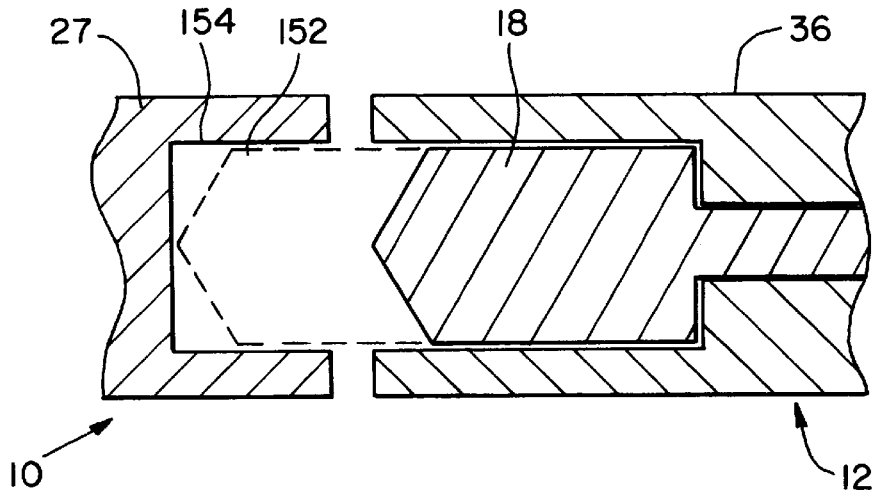
FIG. 7 is a sectional view of the door system and doorjamb of the present invention.

Referring to FIG. 7, door system 10 is shown in an open door position. Lower retractable edge 18 is fully retracted into door 12 and away from door jamb 27. Dotted line 152 indicates the position lower retractable edge 18 would be in when door system 10 is in a closed door position. Door jamb 27 contains door jamb groove 154, which receives retractable edge 18. Complimentary door jamb grooves in door jam 27 receive extending retractable edges 16, 18, and 20 when door 12 is in the closed door position.

Referring back to FIGS. 1*a* and 1*b*, side retractable edge lower corner 91 is slidably connected to side retractable edge 20 and lower retractable edge 18 by bars 84. Bars 84 are disposed in grooves made inside retractable edge 20 and lower retractable edge 18 and side retractable lower corner 91. When door 12 is opened, side retractable lower corner 91 moves upward towards side retractable edge 20 and inward towards lower retractable edge 18.

Figure 9:
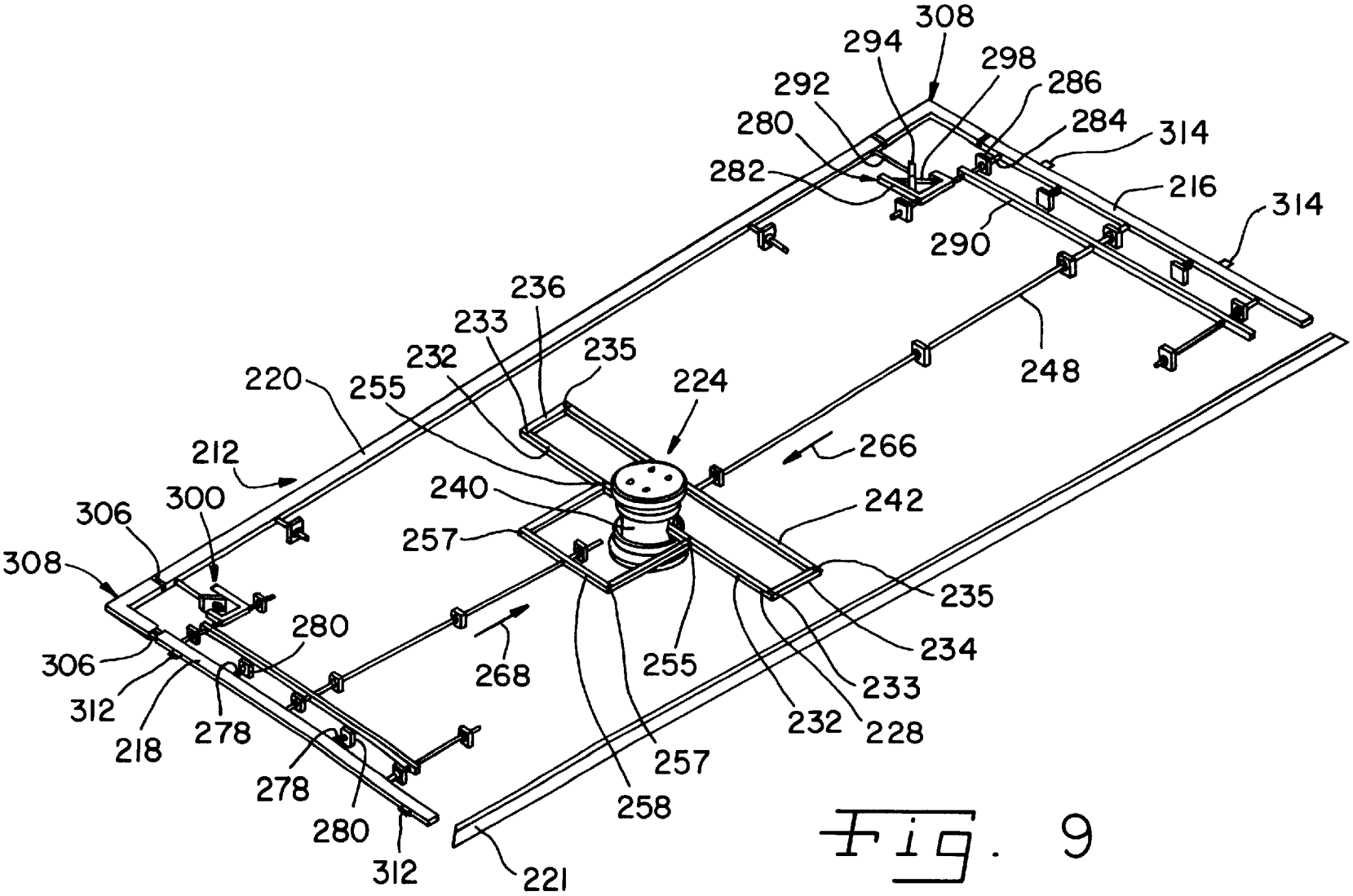
FIG. 9 is a perspective view of the door system of Embodiment II of the present invention in a closed door configuration.

The preferred embodiment is Embodiment II depicted in FIGS. 9–12. Referring now to FIG. 9, door 212 consists of upper retractable edge 216, lower retractable edge 218, side retractable edge 220, and non-retractable edge 221. FIG. 9 depicts door 212 in its closed door configuration.

Embodiment II differs from Embodiment I in the method by which the push button actuator 224 actuates the retraction of upper, lower, and side retractable edges 216, 218, 220, respectively. Like door 12 of Embodiment, door 212 is hung on bidirectional hinges (FIG. 4) and the retractable edges are received into door jamb grooves 154 (FIG. 7) when door 212 is in its closed door position.

Figure 10:
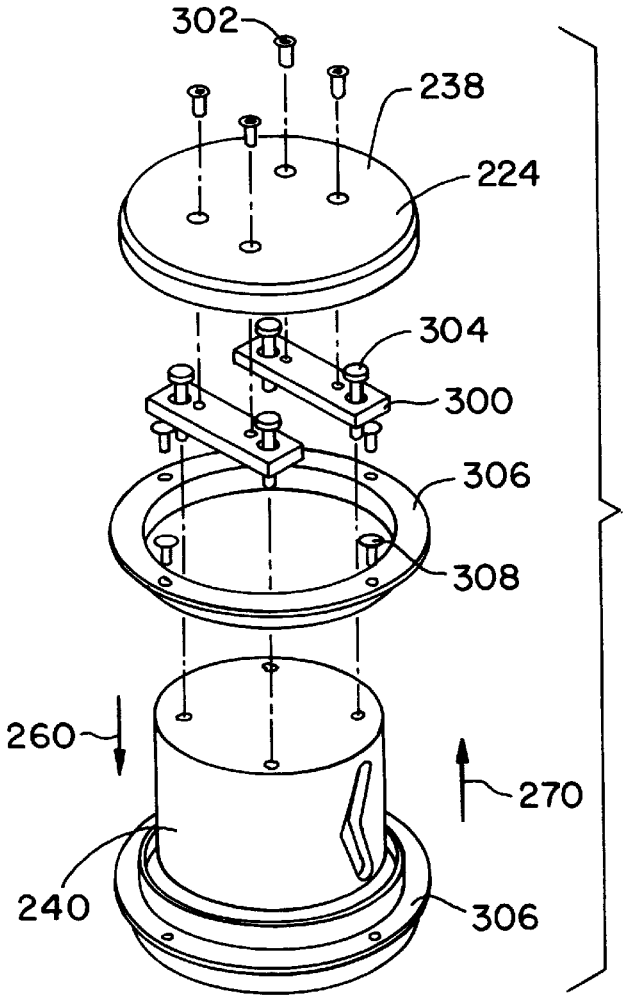
FIG. 10 is an exploded view of a push button actuator of Embodiment II.
Figure 11:
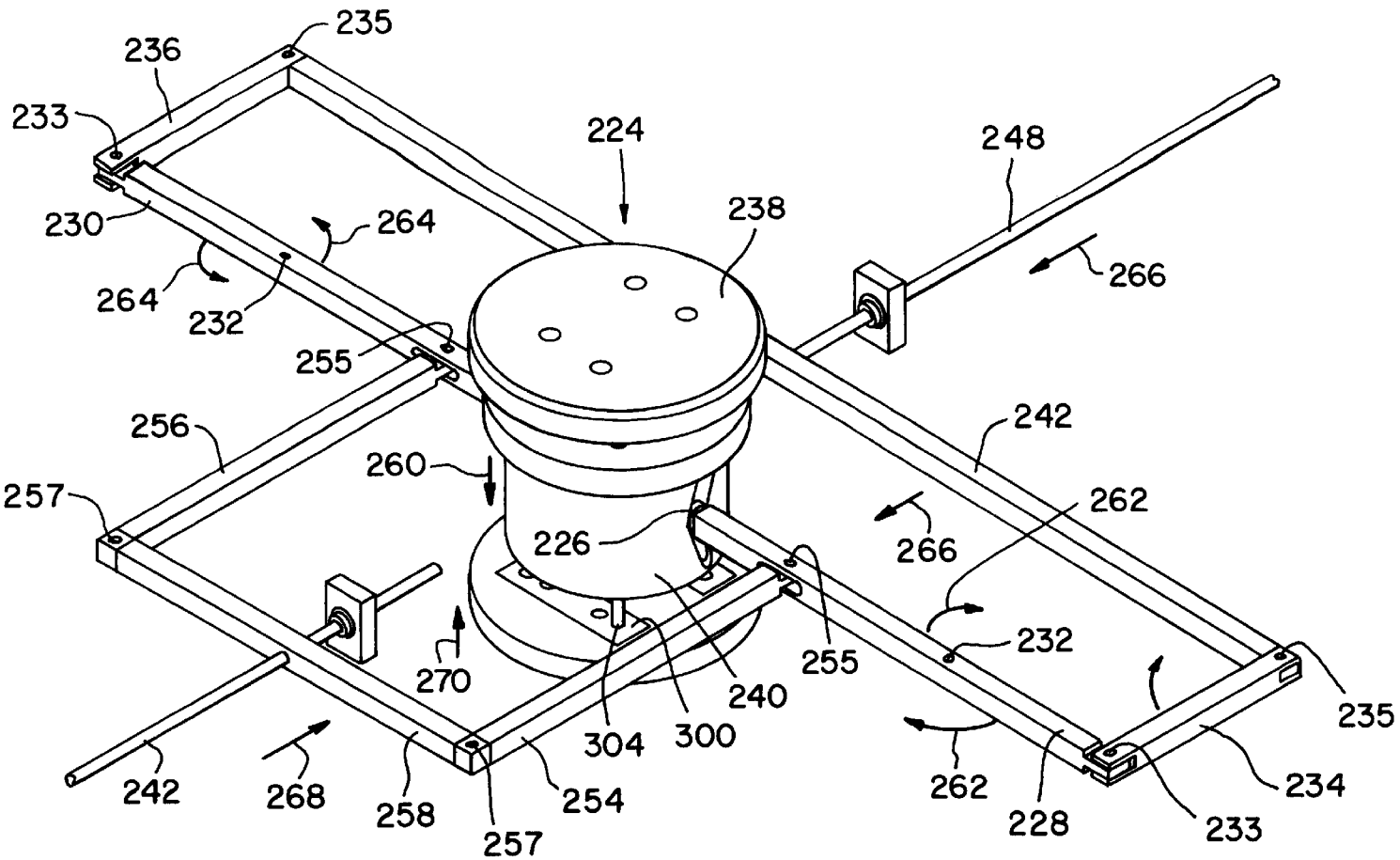
FIG. 11 is an enlargement of FIG. 9 showing a retraction means of Embodiment II.

Best shown in FIGS. 10 and 11, push button actuator 224 activates the retraction of upper, lower, and side retractable edges 218, 218, and 220, respectively. Push button actuator 220 includes pad 238 and actuator cylinder 240.

Push button actuator pad 228 is attached to mounting brace 300 by bolts 302. Mounting brace 300 is then attached to actuator cylinder 240 by slide rods 304. Both actuator brace 300 and slide rods 304 move with push button actuator pad 228. Disposed between push button actuator pad 224 and the front and back face of door 212 (not shown) is actuator cylinder sleeve 306. Actuator cylinder sleeve 257 is attached to the door face by bolts 308 and slidable mounts actuator cylinder 240 to door 212.

Actuator cylinder 240 contains two v-shaped grooves 252, which are cut through cylinder 240. Roller 226 located at the end of right return bar 228. Roller 226 rides within the v-shaped groove 252. Left return bar 230 has located at one end a roller which rides within a similar v-shaped groove in actuator cylinder 240. Right and left return bars 228, 230 are pivotally mounted to door 220 by pins 232. Right and left return bars 228, 230 are pivotally mounted to right and left connecting arms 234, 236 by pins 233. Right and left connecting arms 234, 236 are pivotally mounted to transverse bar 242 by pins 235.

Transverse connecting bar 242 is rigidly connected to upward extending rod 248. Right and left return bars 228, 230 are pivotally mounted to right downward connecting arm 254 and downward left connecting arm 256 by pins 255. Lower transverse connecting arm 258 is pivotally connected to both right and left downward connecting arms 254, 256 by pins 257.

When push button pad 238 is pushed in the direction of the plane of the door, as indicated by directional arrow 260 (FIG. 10), right return bar roller 226 will ride along in v-shaped groove 252 causing right return bar 228 to pivot about pin 232 in the direction of arrow 262. Also, as push button actuator pad 238 is pushed in direction 260 (FIG. 10), left return bar 230's roller rides along the v-shaped groove on the left side of actuator cylinder 240. Consequently, left return bar 230 pivots counter-clockwise about pin 232, as indicated by directional arrow 264. The result of right return bar 228 rotating clockwise and left return bar 230 rotating counter clockwise is that transverse bar 242 is pulled in direction 266. Since transverse bar 242 is connected to upward extending rod 248, upward extending rod 248 is pulled in the direction of 266. Since upward extend rod 266 is connected to upper retractable edge 216, depressing push button actuator 238 (in direction 260) causes upper retractable edge 216 to retract inward into door 212 or in the direction of arrow 266 (FIG. 9).

In addition, when push button actuator 238 is depressed in direction 260, lower transverse connecting arm 258 is pulled in direction 268. Since downward extending rod 242 connects lower retractable edge 218 to lower transverse connecting arm 258, lower retractable edge 218 will retract into door 212 when push button actuator pad 238 is depressed.

When push button actuator pad is pushed in direction 270, right and left return bars 228, 230 will rotate about pin 232, as indicated by arrows 262, 264, respectively. Therefore, regardless which direction push button actuator is pressed, either in the direction of arrow 260 or arrow 270, right and left return bars will rotate in the same direction. Consequently, pushing push button actuator pad 238 in either direction 260 or 270 results in upper and lower retractable edges 216, 218 to retract into door 212 and away from a door jamb.

Figure 12:
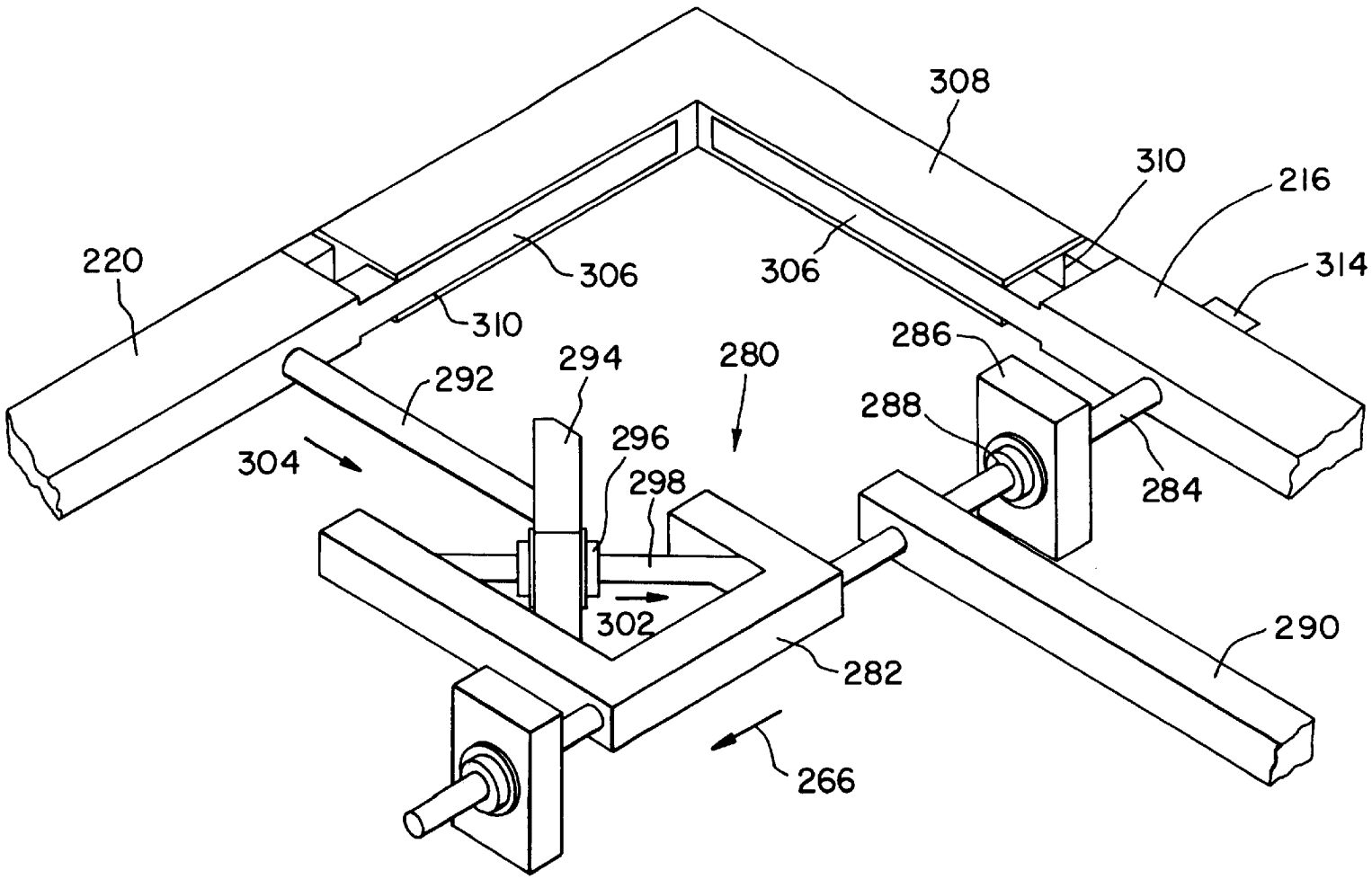
FIG. 12 is an enlargement of FIG. 9 showing a corner member and 45 degree angle member of Embodiment II.

Referring now to FIG. 12, 45 degree angle member 280 consists of support member 282. Support member 282 is rigidly attached to upper retractable edge 216 by support member rod 284. Support member rod 240 traverses guide block 286 through bearing 288. Guide block 286 is rigidly attached to transverse support 290. Transverse support 290 gives rigidity to the system during the retraction of the door edges.

Side retractable shaft 292 extends between side retractable edge 220 and 45 degree angle member guide 294. Forty five degree angle member guide 294 contains bearing 296. Forty five degree angle shaft 296 traverses 45 degree member guide 294 through bearing 296 such that the 45 degree angle guide member rides along shaft 298 in a 45 degree angle.

A lower 45 degree angle member 300 connects the lower portion of side retractable edge 222 the lower retractable edge 218 (FIG. 9).

When upward extending rod 248 retracts in the direction of 266 (i.e., when push button actuator pad 238 is pushed in the direction of either 260 or 270, FIG. 10) support member rod 284 will move in the direction of arrow 266. As a result, 45 degree angle guide member 294 will ride along shaft 298 in the direction of arrow 302. When 45 degree angle guide member 294 moves in direction 302, side retractable edge shaft 292 is pulled in the direction of arrow 304. Since side retractable edge shaft 292 is rigidly attached to both side retractable edge 220 and to 45 degree angle guide member 294, side retractable edge 220 is also retracted into door 212, as indicated by direction arrow 304.

At the ends of upper, lower, and side retractable edges 216, 218, and 220, are a pair of extending fingers 306.

Corner member 308 contains channels 310, which are complimentary to extending fingers 306. Corner member 306 is slidable attached to fingers 306 such that when upward, downward, and side retractable edges retract into door 212, fingers 306 slide within channels 310.

Referring back to FIG. 9, lower and upper retractable edges 218, 216 are biased in their close door position by a plurality of springs 278. Lower retractable edge 218 and upper retractable edge 216 contain retractable edge rollers 312, 314, respectively. Lower rollers 312 roll along the surface of a floor once lower retractable edge 218 is liberated from a groove located in the lower portion of a door jamb. Lower retractable edge 218 is biased against the surface of a floor such that when door 212 is pushed closed, rollers 312 will roll along the surface of the floor and help guide side lower retractable edge 218 into a groove located in the lower portion of a door jamb.

Upper retractable edge 216, with roller 314, contacts a striker plate located in the upper door jamb (not shown). When door 212 is closed, roller 314 makes contact with the striker plate whereby upper retractable edge 216 slightly depresses into door 212 in the direction of arrow 266. The biased upper retractable edge 216 then extends into a groove in the upper door jamb whereby returning upper retractable edge 216 to its closed confirmation. When upper and lower retractable edges 216, 218 retract into a door jamb, side retractable edge 220 extends into a groove in the side of a door jamb whereby all three edges, upper, lower, and side retractable edges 216, 218, and 220, seal within a door jamb.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A door system comprising:

a door with a front face, a back face, and at least one retractable edge, said door connected by a bi-directional hinge to a doorjamb, said retractable edge extendable into the doorjamb; and retraction means for retracting said retractable edge from the doorjamb to permit said door to swing on said hinge, said retraction means comprising a push button actuator located on both said front face and said back face of said door.

2. A door system according to claim 1 wherein said door comprises three retractable edges extendable into the doorjamb.

3. A door system according to claim 2 further comprising:

said three retractable edges comprise an upper retractable edge, a lower retractable edge, and a side retractable edge, respectively;

said retraction means comprising:

a push button actuator;

an upward extending rod and a downward extending rod, said rods having a first and a second end, said upward extending rod first end attached to said upper retractable edge, said upward extending rod second end retractably attached to said push button actuator, said downward extending rod first end attached to said lower retractable edge, said downward extending rod second end retractably attached to said push button actuator;

a plurality of trapezoidal members located along said upward and downward extending rod, said trapezoidal members having an angled surface;

a plurality of transverse rods having two ends, one said transverse rod end attached to said side retractable edge, a roller affixed to a second said transverse rod end, said roller rollable along said angled surface of said trapezoidal member whereby movement of said upward extending rod and downward toward said push button actuator, permits said transverse rods to move toward said upward extending rod and downward extending rod.

4. A door system comprising:

a door with at least one retractable edge, said door connected by a bi-directional hinge to a doorjamb, said retractable edge extendable into the doorjamb; and retraction means for retracting said retractable edge from the doorjamb to permit said door to swing on said hinge, said retraction means comprising:

a cylinder return bar operatively connected to said retractable edge, said cylinder return bar having an open and close position, wherein said open position prevents said retractable edge from extending into the doorjamb and said closed position permits said retractable edge to extend toward said doorjamb; and a lever with a cable extending from said door, said cable attached to the doorjamb; said lever operatively connected to said cylinder return bar such that when said door is opened, said cable is pulled in a direction out of said door causing said cylinder return bar to move from said return bar close position to said return bar open position.

5. A door system comprising:

a door with an upper retractable edge, a retractable lower, and a side retractable edge; said door containing a front face and a back face; said door bi-directionally hinged to a doorjamb, said retractable edge extendable into the doorjamb;

a push button actuator activate retraction of said upper retractable edge, lower retractable edge, and side retractable edge;

an upward extending rod and a downward extending rod, said rods having a first and a second end, said upward extending rod first end attached to said upper retractable edge, said upward extending rod second end retractably attached to said push button actuator, said downward extending rod first end attached to said lower retractable edge, said downward extending rod second end retractably attached to said push button actuator;

a plurality of trapezoidal members located along said upward extending rod and said downward extending rod, said plurality of trapezoidal members containing an angled surface;

a plurality of transverse rods having two ends, one said transverse rod end attached to said side retractable edge;

a roller affixed to said second transverse rod end, said roller rollable along said angled surface of said trapezoidal member whereby movement of said upward extending rod and downward extending rod toward said push button actuator permits said plurality of transverse rods to move toward said upward extending rod and downward extending rod;

a cylinder return bar operatively connected to said upper retractable edge, lower retractable edge, and said side retractable edge, said cylinder return bar having an open and close position; said open position prevents said upper retractable edge, lower retractable edge, and said side retractable edge from extending into the doorjamb, said closed position permits said upper retractable edge, lower retractable edge, and said side retractable edge to extend toward said doorjamb;

a lever with cable extending from said door, said cable attached to the doorjamb; said lever operatively connected to said cylinder return bar such that when said door is opened, said cable is pulled in a direction out of said door causing said cylinder return bar to move from said return bar close position to said return bar open position.

* * * * *